United States Patent [19]

Baugh

[11] 3,984,029

[45] Oct. 5, 1976

[54] GOLF ACCESSORY

[75] Inventor: Alvin L. Baugh, Affton, Mo.

[73] Assignee: Lawrence Peska Associates, Inc., New York, N.Y. ; a part interest

[22] Filed: Jan. 15, 1976

[21] Appl. No.: 649,316

[52] U.S. Cl. ..... 221/2; 221/256

[51] Int. Cl.[2] ..... G09F 9/46

[58] Field of Search ..... 235/1 B, 1 C; 221/2, 221/256, 309; 206/315 B

[56] References Cited

UNITED STATES PATENTS

| | | | |
|---|---|---|---|
| 1,333,479 | 3/1920 | Farmer | 221/256 |
| 1,940,134 | 12/1933 | Levin | 235/1 B |
| 3,773,461 | 11/1973 | Arimoto et al. | 221/256 X |

*Primary Examiner*—Stanley H. Tollberg
*Attorney, Agent, or Firm*—Eugene V. Mandel

[57] ABSTRACT

A golf accessory for dispensing balls and tees and for keeping score tally. A ball tube has a pivotable retainer while a score keeping ring is rotatable about the tube.

11 Claims, 4 Drawing Figures

FIG. 1
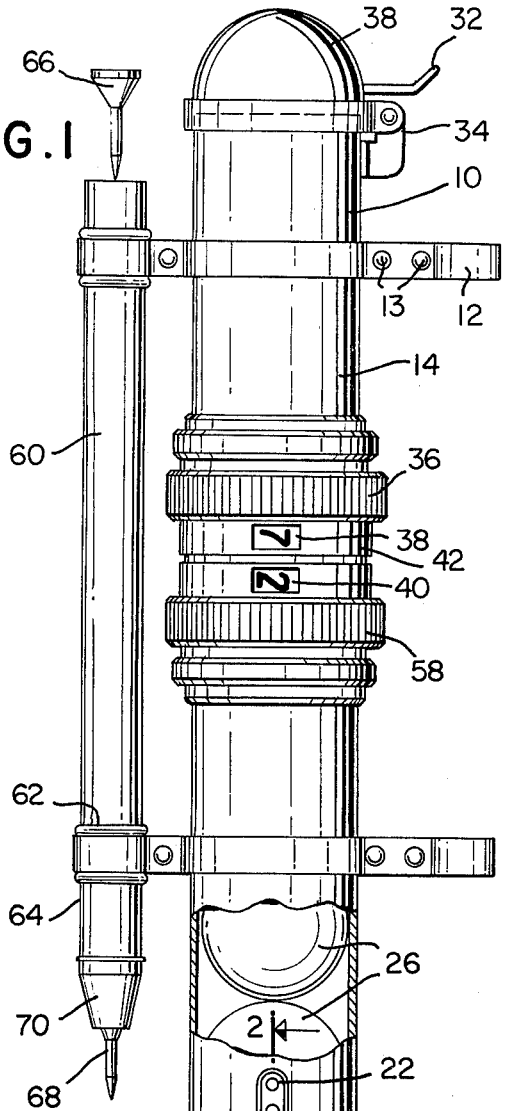
FIG. 3
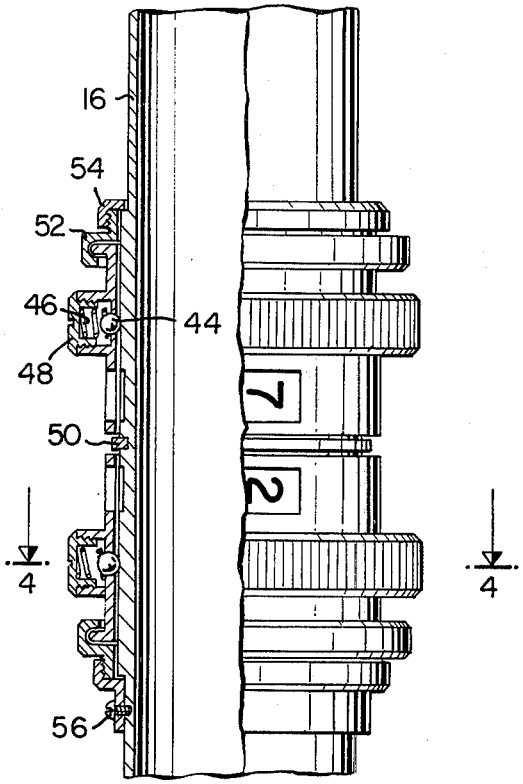
FIG. 4
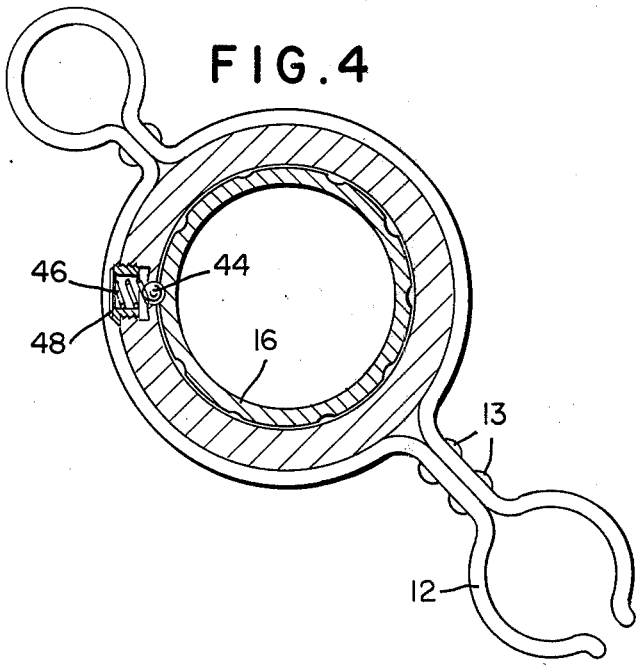
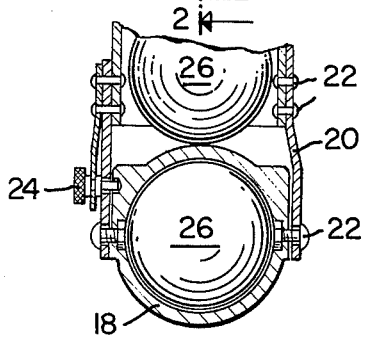
FIG. 2

GOLF ACCESSORY

BACKGROUND OF THE INVENTION

This invention relates to a golf accessory for convenience in transporting small, loseable components. It relates to storage equipment, and it further relates to dispensing equipment. It also relates to publicly displaying score keeping.

Various golf accessories have been known in the past. These have included golf ball storage equipment, usually in tubular form. and some have even had golf ball dispensers. The storage devices have also been known, including dispensers, even having a ball detent to discourage rapid wasteful dispensing.

Some scorekeepers had also been devised in the past for golf.

The object of this invention is a convenient golf accessory for organizing, storing, transporting, and dispensing the small components used in the game of golf, particularly of balls and tees. A further purpose is to keep score on a simple device, in a manner that is open to public view.

The essence of this invention is a compact golf accessory capable of being carried or transported on a golf carrier such as a golf cart, which stores and dispenses balls, stores and reluctantly dispenses tees, and can have the score tallied. The provision of one-at-a-time dispensing may even pay for the accessory over a period of time in balls saved.

DESCRIPTION OF DRAWINGS

FIG. 1 is an external side elevation of the complete equipment.

FIG. 2 is a sectional view taken at 2—2.

FIG. 3 is an enlarged external and sectional view of a score tally keeping device.

FIG. 4 is a sectional view taken at 4—4.

Further objects and advantages of this invention will appear more clearly from the following description of a non-limiting illustrative embodiment and the accompanying drawings in which like numerals designate like parts thruout the several views.

DESCRIPTION OF TYPICAL EMBODIMENT

In the drawings a golf accessory 10 embodying features of the invention is illustrated.

One or more clamps 12 are used to hold together a ball container 14 and a tee container 60 and to mount the assembly to any convenient carrier such as a golf cart. Ball container 14 is a hollow tube 16 slightly larger than the golf balls 26 and fitted at its lower exit end with a retainer and dispenser 18 mounted via fasteners 22 and 24 and links 20 to tube 14. Dispenser 18 may be provided with an inner curved shape to fit ball 26 and may also have a knob 28 for easy handling. Fastener 24 may be of a locking type to secure the dispenser 18 in the open or closed position.

The ball storage tube may also be provided with a dust cover 30 pivoted and attached at 34 and provided with a convenient finger flip control 32.

The storage tube 64 is slightly larger than tees 66 to permit storage in a stacked manner and is retained to clamps 12 with the assistance of bushing 62, which may be soft, as of rubber or plastic.

The lower exit end of tube 64 is fitted with a soft retarder 70 to restrict the rapidity of exit of tees 66 with point 68 leading. The retarder 70 may be squeezed to dispense a tee, or the tee may just be pulled.

A ring 42 with numbers 40 may be fitted about a tube such as ball carrier 14. The ring may carry numbers and be indexed past a fixed reading point, or the ring may have a window 38 thru which a number 40 on the surface of tube 16 may be read. The ring may have serrations or knurls 36 for convenience in manual indexing. One or more additional rings 58 may be used to increase the numerical capacity of this score keeper. One row of figures would be used for digits, a second for tens, and perhaps a third may be considered for hundreds?

The ring's angular position may be secured by a device such as a ball detent comprising ball 44, spring 46 and screw 48. The rotatable numbering rings may be retained on the tube by shoulders, snap rings 50, locknuts 54, keeper rings 52 and set screws 56. Clamps 12 may be retained by fasteners 13.

Of course, a friction securing device to restrict ring rotation can be used instead of the ball detent.

The combination of these accessories will lighten the golfer's load and permit more attention to the game.

The invention includes all novelty residing in the description and drawings. It is obvious to those skilled in the art that various minor changes can be made without departing from the concept of this invention and all such as fall within the reasonable scope of the appended claims are claimed.

What is claimed is:

1. A golf accessory comprising in combination: at least one ball storage and dispensing unit comprising a hollow tube fitted at its lower exit end with a pivotable ball fitting retainer and dispenser which holds a single ball and blocks the other balls in the tube when the retainer is pivoted for single ball dispensing, at least one golf tee storage and dispensing unit comprising a hollow tube for holding a plurality of tees and movable exit restriction means at the bottom end of the tube, at least one score keeping and indicating unit comprising at least one series of numbers and at least one ring rotatable about the ball storage tube, said ring having number display means, and at least one clamp for holding the abovementioned units together so they can be handled and employed as a single unit.

2. A golf accessory as in claim 1 further comprising at least one clamp for mounting the assembled unit to any golf carrier.

3. A golf accessory as in claim 1 further comprising a removable cover for the ball storage unit.

4. A golf accessory as in claim 1 further comprising stable tally retention means for the scope keeper and indicator.

5. A golf accessory as in claim 4 having friction tally retention means.

6. A golf accessory as in claim 4 having digital detent tally retention means.

7. A golf accessory as in claim 6 having ball detent tally retention means.

8. A golf accessory as in claim 1 having a series of numbers on a rotatable ring.

9. A golf accessory as in claim 1 having a series of numbers on a stationary part near the rotatable ring such as the tube and number indicating means on a ring.

10. A golf accessory as in claim 9 having a window in the ring.

11. A golf accessory as in claim 1 having a score keeper comprising at least two rotatable rings, one ring for digits, the second ring for tens, and so on.

* * * * *